US005940885A

United States Patent [19]

Matthews

[11] Patent Number: 5,940,885

[45] Date of Patent: Aug. 24, 1999

[54] HEAD WASHING CAP

[76] Inventor: Joan Matthews, 1730 Carroll Apt.# A3, Brooklyn, N.Y. 11213

[21] Appl. No.: 09/209,811

[22] Filed: Dec. 11, 1998

[51] Int. Cl.[6] ..... A45D 44/08

[52] U.S. Cl. ..... 2/174; 4/521

[58] Field of Search ..... 2/50, 174; 4/521

[56] References Cited

U.S. PATENT DOCUMENTS 2,600,392 6/1952 Cancell ..... 2/174

5,146,629 9/1992 Barnes ..... 2/174

*Primary Examiner*—Diana L. Oleksa

[57] ABSTRACT

A cap is provided for preventing water from coming in contact with a face of a user. Included is an elastic closed loop band and a dish portion. The dish portion includes a resilient sheet with a bottom edge integrally coupled to the closed loop band and extending upwardly and outwardly therefrom with an arcuate vertical cross-section. A peripheral member is integrally coupled to an upper peripheral edge of the sheet of the dish portion. Also included is a water channel having a substantially planar plate with an inboard end coupled to the upper peripheral edge of the sheet of the dish portion and extending upwardly and outwardly therefrom.

8 Claims, 2 Drawing Sheets

HEAD WASHING CAP

BACKGROUND OF THE INVENTION

1. Field of the Invention

The present invention relates to shower caps and more particularly pertains to a new head washing cap for preventing water from coming in contact with a face of a user while washing hair.

2. Description of the Prior Art

The use of shower caps is known in the prior art. More specifically, shower caps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 5,146,629; U.S. Pat. No. 4,611,354; U.S. Pat. No. 4,605,017; U.S. Pat. No. 5,097,777; U.S. Pat. No. 4,014,054; and U.S. Pat. No. Des. 266,193.

In these respects, the head washing cap according to the present invention substantially departs from the conventional concepts and designs of the prior art, and in so doing provides an apparatus primarily developed for the purpose of preventing water from coming in contact with a face of a user while washing hair.

SUMMARY OF THE INVENTION

In view of the foregoing disadvantages inherent in the known types of shower caps now present in the prior art, the present invention provides a new head washing cap construction wherein the same can be utilized for preventing water from coming in contact with a face of a user while washing hair.

The general purpose of the present invention, which will be described subsequently in greater detail, is to provide a new head washing cap apparatus and method which has many of the advantages of the shower caps mentioned heretofore and many novel features that result in a new head washing cap which is not anticipated, rendered obvious, suggested, or even implied by any of the prior art shower caps, either alone or in any combination thereof.

To attain this, the present invention generally comprises an elastic closed loop band with an outer face, an inner face and a top and bottom edge formed therebetween. In use, the band is adapted for being positioned about a face of a user below a hairline thereof. Next provided is a dish portion including a resilient sheet with a bottom edge integrally coupled to the bottom edge of the closed loop band. The resilient sheet extends upwardly and outwardly from the band with an arcuate vertical cross-section. As such, an upper peripheral edge is defined which resides in a single plane parallel with the band and elevated with respect thereto a distance equal about 3 times a height of the band. A shown in FIGS. 2 & 3, a plurality of ribs are mounted on an upper surface of the sheet and extend radially from the band to the upper peripheral edge of the sheet of the dish portion. Also included is a peripheral tube integrally coupled to the upper peripheral edge of the sheet of the dish portion. Ideally, the peripheral tube encompasses about 270–320 degrees of the dish portion. Further, a diameter of a cross-section of the peripheral tube is about the height of the band. Finally, a water channel includes a planar plate having an inboard end coupled to the upper peripheral edge of the sheet of the dish portion. The plate of the water channel extends upwardly and outwardly from the dish portion such that a plane in which the plate resides forms a 70–90 degree angle with respect to an axis of the dish portion. The plate of the water channel preferably has a periphery with an inboard extent which diverges outwardly. As shown in FIG. 3, the periphery of the plate of the water channel is further equipped with an outboard extent which converges inwardly and has a length at least twice that of the inboard extent. The plate of the water channel has a pair of upwardly extending lips coupled to opposite side edges of the periphery for directing fluid to an open end of the water channel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new head washing cap apparatus and method which has many of the advantages of the shower caps mentioned heretofore and many novel features that result in a new head washing cap which is not anticipated, rendered obvious, suggested, or even implied by any of the prior art shower caps, either alone or in any combination thereof.

It is another object of the present invention to provide a new head washing cap which may be easily and efficiently manufactured and marketed.

It is a further object of the present invention to provide a new head washing cap which is of a durable and reliable construction.

An even further object of the present invention is to provide a new head washing cap which is susceptible of a low cost of manufacture with regard to both materials and labor, and which accordingly is then susceptible of low prices of sale to the consuming public, thereby making such head washing cap economically available to the buying public.

Still yet another object of the present invention is to provide a new head washing cap which provides in the apparatuses and methods of the prior art some of the advantages thereof, while simultaneously overcoming some of the disadvantages normally associated therewith.

Still yet another object of the present invention is to provide a new head washing cap for preventing water from coming in contact with a face of a user while washing hair.

Even still another object of the present invention is to provide a new head washing cap for preventing water from coming in contact with a face of a user. Included is an elastic closed loop band and a dish portion. The dish portion includes a resilient sheet with a bottom edge integrally coupled to the closed loop band and extending upwardly and outwardly therefrom with an arcuate vertical cross-section. A peripheral member is integrally coupled to an upper peripheral edge of the sheet of the dish portion. Also included is a water channel having a substantially planar plate with an inboard end coupled to the upper peripheral edge of the sheet of the dish portion and extending upwardly and outwardly therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
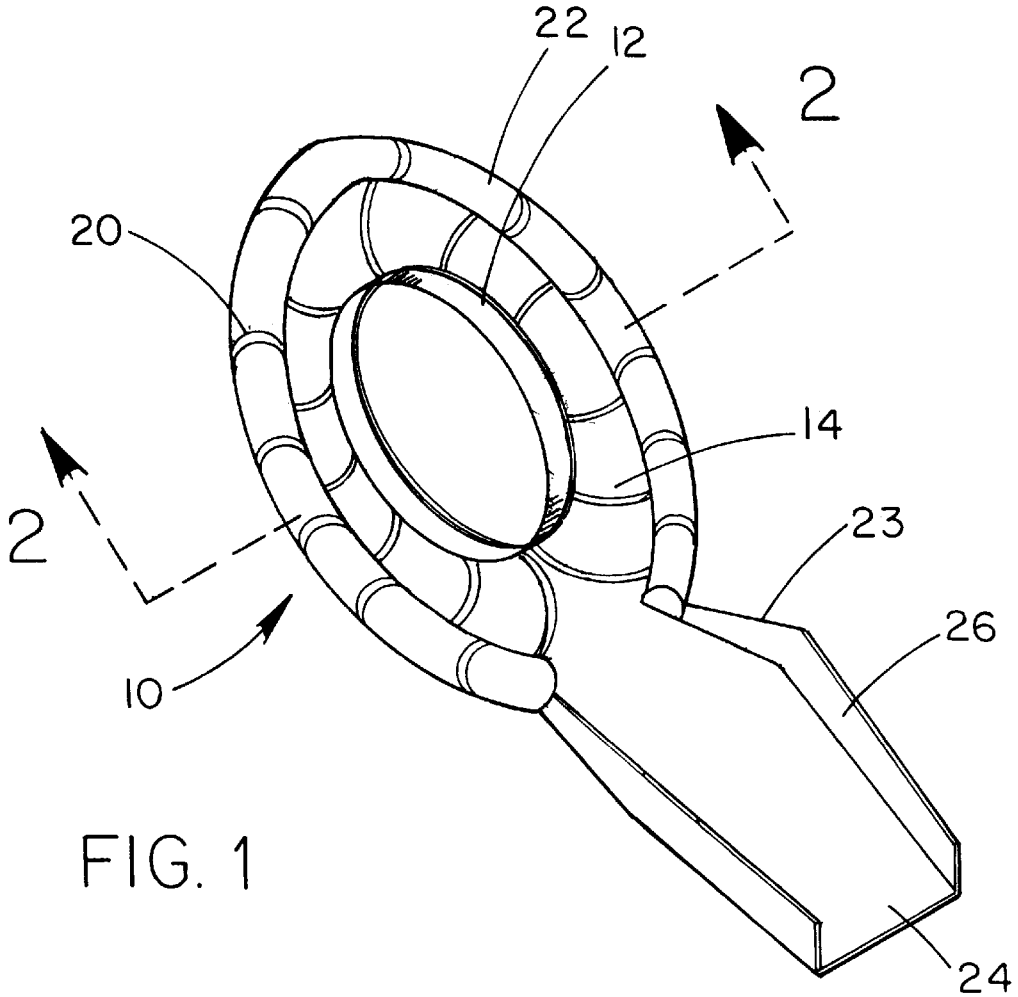
FIG. 1 is a perspective view of a new head washing cap according to the present invention.

With reference now to the drawings, and in particular to FIGS. 1 through 5 thereof, a new head washing cap embodying the principles and concepts of the present invention and generally designated by the reference numeral 10 will be described.

The present invention, designated as numeral 10, includes an elastic closed loop band 12 with an outer face, an inner face and a top and bottom edge formed therebetween. In use, the band is adapted for being positioned about a face of a user below a hairline thereof. It should be noted that the band may also be equipped with overlapping flaps or pleats to accommodate heads of varying size.

Figure 2:
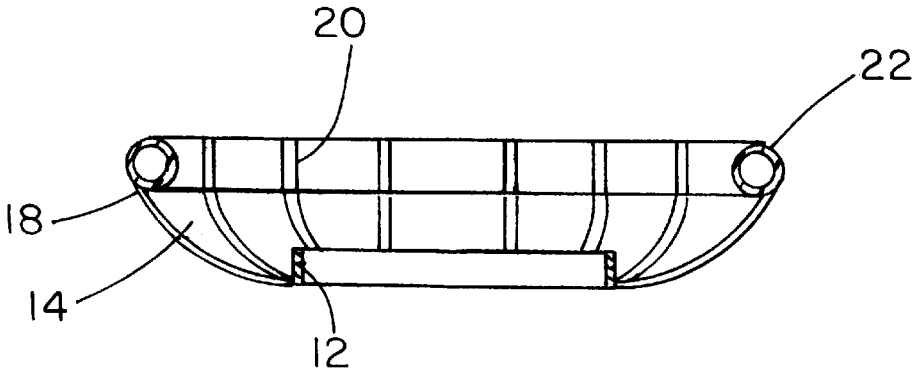
FIG. 2 is a side cross-sectional view of the present invention taken along line 2—2 shown in FIG. 1.
Figure 3:
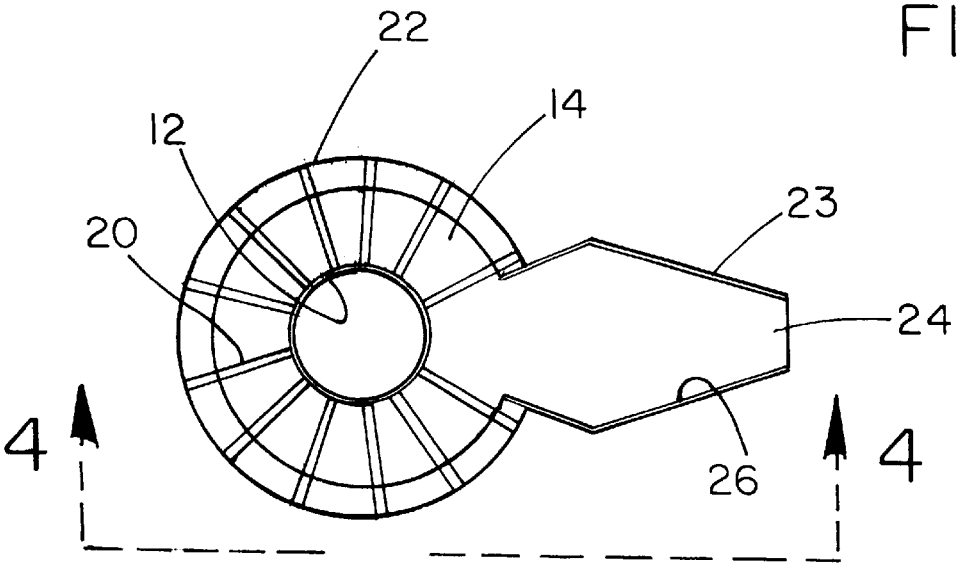
FIG. 3 is a top view of the present invention.

Next provided is a dish portion 14 including a flexible resilient sheet with a bottom edge integrally coupled to the bottom edge of the closed loop band. The resilient sheet extends upwardly and outwardly from the band with an arcuate vertical cross-section. As such, an upper peripheral edge 18 is defined which resides in a single plane parallel with the band and elevated with respect thereto a distance equal about 3 times a height of the band. Ideally, a radius of the dish portion is about 3 times that of the band. Further, the dish portion preferably defines a portion of a sphere. As shown in FIGS. 2 & 3, a plurality of rigid ribs 20 are mounted on an upper surface of the sheet and extend radially from the band to the upper peripheral edge of the sheet of the dish portion for strengthening purposes. As an option, a bottom surface of the dish portion may also be lined with a terry cloth or other type of absorbent material while the top surface is lined with plastic.

Also included is a flexible resilient peripheral tube 22 integrally coupled to the upper peripheral edge of the sheet of the dish portion. Ideally, the peripheral tube encompasses about 270–320 degrees of the dish portion. Further, a diameter of a cross-section of the peripheral tube is about equal to the height of the band.

Figure 4:
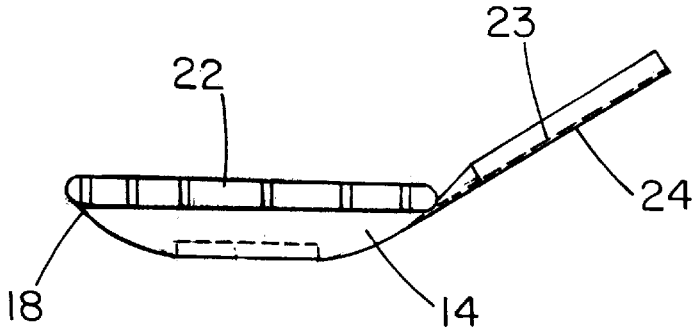
FIG. 4 is a side view of the present invention.
Figure 5:
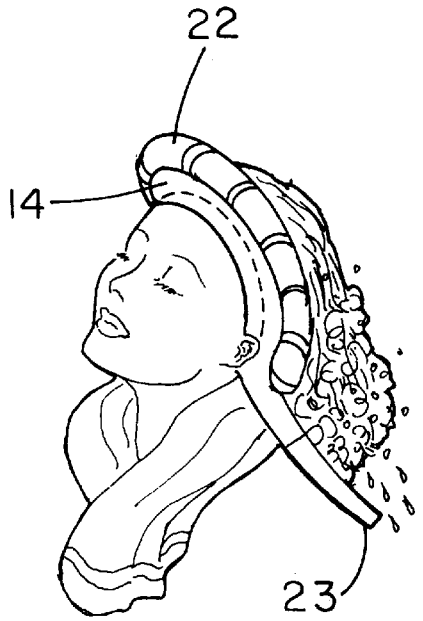
FIG. 5 is a perspective view of the present invention during use.

Finally, a water channel 23 includes a planar plate 24 having an inboard end coupled to the upper peripheral edge of the sheet of the dish portion. The plate of the water channel extends upwardly and outwardly with respect to an open top of the dish portion such that a plane in which the plate resides forms a 70–90 degree angle with respect to an axis of the dish portion. As shown in FIG. 4, such angle is preferably similar to an average angle of the dish portion.

The plate of the water channel preferably has a periphery with an inboard extent which diverges outwardly and is constrained by and in alignment with a pair of the ribs of the dish portion. As shown in FIG. 3, the periphery of the plate of the water channel is further equipped with an outboard extent which converges inwardly and has a length at least twice that of the inboard extent. The plate of the water channel has a pair of upwardly extending lips 26 coupled to opposite side edges of the periphery for directing fluid to an open end of the water channel. As shown in FIG. 1, the lips of the outboard extent of the periphery of the water channel are preferably of a constant height while the lips of the inboard extent are tapered.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cap for preventing water from coming in contact with a face of a user, the cap comprising:

an elastic closed loop band with an outer face, an inner face and a top and bottom edge formed therebetween for being positioned about a face of a user below a hairline thereof;

a dish portion including a resilient sheet with a bottom edge integrally coupled to the bottom edge of the closed loop band and extending upwardly and outwardly therefrom with an arcuate vertical cross-section, thereby defining an upper peripheral edge which resides in a single plane parallel with the band and elevated with respect thereto a distance equal about 3 times a height of the band, wherein a plurality of ribs are mounted on an upper surface of the sheet and extend radially from the band to the upper peripheral edge of the sheet of the dish portion;

a peripheral tube integrally coupled to the upper peripheral edge of the sheet of the dish portion and encompassing about 270–320 degrees thereof, wherein a diameter of a cross-section of the peripheral tube is about the height of the band; and a water channel including a planar plate having an inboard end coupled to the upper peripheral edge of the sheet of the dish portion and extending upwardly and outwardly therefrom such that a plane in which the plate resides forms a 70–90 degree angle with respect to an axis of the dish portion, the plate of the water channel having a periphery with an inboard extent which diverges outwardly and an outboard extent which converges inwardly and has a length at least twice that of the inboard extent, wherein the plate of the water channel has a pair of upwardly extending lips coupled to opposite side edges of the periphery for directing fluid to an open end of the water channel.

2. A cap for preventing water from coming in contact with a face of a user, the cap comprising:

an elastic closed loop band;

a dish portion including a resilient sheet with a bottom edge integrally coupled to the closed loop band and extending upwardly and outwardly therefrom with an arcuate vertical cross-section;

a peripheral member integrally coupled to an upper peripheral edge of the sheet of the dish portion; and a water channel including a plate having an inboard end coupled to the upper peripheral edge of the sheet of the dish portion and extending upwardly and outwardly therefrom.

3. A cap as set forth in claim 2 wherein the plate has a periphery with a diverging inboard extent and a converging outboard extent.

4. A cap as set forth in claim 2 wherein a plane in which the plate resides forms a 70–90 degree angle with respect to an axis of the dish portion.

5. A cap as set forth in claim 2 wherein the plate of the water channel has a pair of upwardly extending lips coupled to opposite side edges of a periphery of the plate for directing fluid to an open end of the water channel.

6. A cap as set forth in claim 2 wherein the peripheral member of the tube includes a peripheral tube encompassing about 270–320 degrees of the dish portion.

7. A cap as set forth in claim 6 wherein a diameter of a cross-section of the peripheral tube is about equal to a height of the band.

8. A cap as set forth in claim 2 wherein the dish portion is lined with a plurality of radially extending strengthening ribs.

* * * * *